US005941303A

United States Patent [19]

Gowan et al.

[11] Patent Number: 5,941,303

[45] Date of Patent: Aug. 24, 1999

[54] EXTRUDED MANIFOLD WITH MULTIPLE PASSAGES AND CROSS-COUNTERFLOW HEAT EXCHANGER INCORPORATING SAME

[75] Inventors: James D. Gowan; Qi Wang, both of Montgomery, Ala.

[73] Assignee: Thermal Components, Montgomery, Ala.

[21] Appl. No.: 08/964,024

[22] Filed: Nov. 4, 1997

[51] Int. Cl.[6] ..... F28D 7/06

[52] U.S. Cl. ..... 165/176; 165/174; 165/140

[58] Field of Search ..... 165/173, 174, 165/176, 140

[56] References Cited

U.S. PATENT DOCUMENTS

| | | | |
|---|---|---|---|
| 31,441 | 2/1861 | Cragg et al. . | |
| Re. 35,502 | 5/1997 | Hughes et al. . | |
| 1,701,617 | 2/1929 | Hyde | 165/140 |
| 3,181,525 | 5/1965 | McKann . | |
| 3,675,710 | 7/1972 | Ristow . | |
| 4,190,101 | 2/1980 | Hartmann . | |
| 4,829,780 | 5/1989 | Hughes et al. . | |
| 5,009,262 | 4/1991 | Halstead et al. | 165/173 |
| 5,086,835 | 2/1992 | Shinmura . | |
| 5,107,924 | 4/1992 | Herbert et al. | 165/173 |
| 5,157,944 | 10/1992 | Hughes et al. . | |
| 5,174,373 | 12/1992 | Shinmura . | |
| 5,176,200 | 1/1993 | Shinmura . | |
| 5,186,248 | 2/1993 | Halstead . | |
| 5,203,407 | 4/1993 | Nagasaka | 165/174 |
| 5,228,315 | 7/1993 | Nagasaka et al. . | |
| 5,348,081 | 9/1994 | Halstead et al. . | |
| 5,400,853 | 3/1995 | Wolters . | |
| 5,582,239 | 12/1996 | Tsunoda et al. . | |

FOREIGN PATENT DOCUMENTS

| | | | |
|---|---|---|---|
| 488572 | 12/1952 | Canada | 165/176 |
| 63-6392 | 1/1998 | Japan | 165/176 |
| 387330 | 12/1923 | United Kingdom | 165/140 |
| 1808634 | 11/1968 | United Kingdom | 165/173 |
| 88-029962 | 1/1988 | United Kingdom | 165/173 |
| 3803-599 | 8/1989 | United Kingdom | 165/176 |
| 3813-339 | 11/1989 | United Kingdom | 165/173 |

*Primary Examiner*—Carl D. Price
*Assistant Examiner*—Terrell McKinnon
*Attorney, Agent, or Firm*—Thelen Reid & Priest LLP

[57] ABSTRACT

A cross-counterflow heat exchanger comprising a pair of identical and identically-oriented, spaced manifolds and a plurality of parallel heat exchanger tubes extending between the manifolds. Each of the manifolds has an interior, longitudinally-extending dividing wall. In a 2n pass heat exchanger, each manifold is symmetric about a mirror plane, the dividing wall is configured to define n+1 upper channels and n lower channels, and the passages of the heat exchanger tubes are divided into 2n flow paths, n being a positive integer. In a 2n+1 pass heat exchanger, each manifold is symmetric about a rotation axis, the dividing wall is configured to define n+1 upper channels and n+1 lower channels, and the passages of th heat exchanger tubes are divided into 2n+1 flow paths, n again being a positive integer. Further, in a 2n pass heat exchanger, the dividing wall of each of the manifolds includes 2n−1 vertical webs, and each of the heat exchanger tubes includes 2n−1 partitions dividing the passages into 2n flow paths; while in a 2n+1 heat exchanger, the dividing wall of each of the manifolds includes including 2n vertical webs, and each of the heat exchanger tubes includes 2n partitions dividing the passages into 2n+1 flow paths. When the number of vertical webs is greater than 1 (that is, when n>1), the vertical webs alternately extend from opposite interior surfaces of the manifold. In both 2n and 2n+1 pass heat exchangers, the partitions of the heat exchanger tubes have notches at both ends for engaging the vertical sections of the manifolds. The dividing wall includes two transverse webs extending outwardly from each vertical web. These transverse webs can be configured as, for example, planar webs extending diagonally in opposite directions to form a zig-zag pattern (a series of interlocking, alternatingly-oriented Y-shapes), as coplanar webs, or as reverse curves forming a sinusoidal pattern. Different manifold geometries can be used, including, but not limited to circular, oval, flattened oval, and rectangular.

27 Claims, 6 Drawing Sheets

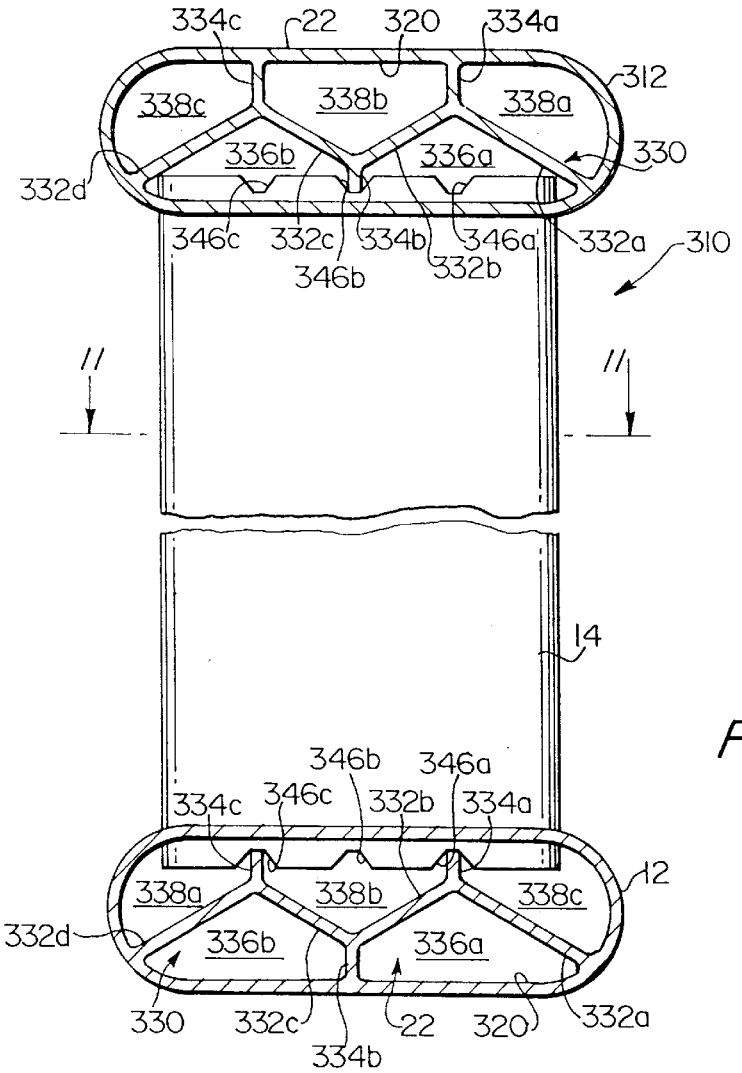
FIG. 10
FIG. 11
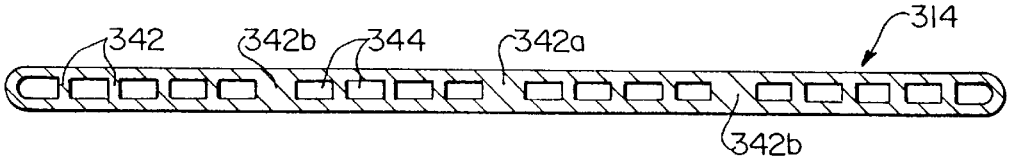
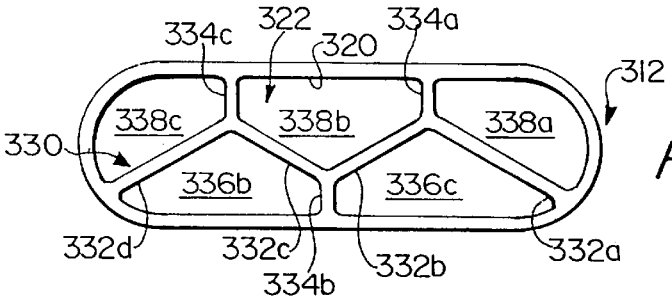
FIG. 12

EXTRUDED MANIFOLD WITH MULTIPLE PASSAGES AND CROSS-COUNTERFLOW HEAT EXCHANGER INCORPORATING SAME

BACKGROUND OF THE INVENTION

1. Field of the Invention

The present invention relates to extruded manifolds with multiple passages. More specifically, the invention relates to extruded manifolds with multiple passages and cross-counterflow heat exchangers incorporating such extruded manifolds, which are suitable for use as commercial or residential condensers or evaporators.

2. Related Art

Air-cooling (or heating) cross-counterflow heat exchangers are well-known. In real-world applications, due to space limitations in many cases, the heat exchangers cannot be made with a large frontal surface area. In order to have sufficient overall heat transfer area to meet design performance requirements, the heat exchanger core has to be increased by adding rows of heat exchanger modules. The multi-row heat exchanger thus becomes necessary in practice. In current parallel-flow heat exchanger technology, such multi-row heat exchangers comprise a plurality of stacked, assembled modules, each module comprising a pair of spaced headers or manifolds interconnected by a plurality of spaced, parallel, flattened heat exchanger tubes and heat exchanger fins interposed between the heat exchanger tubes.

The concept of the cross-counterflow heat exchanger can be realized in multi-row heat exchanger designs. Typically, the cross-counterflow heat exchanger is arranged so that heat-exchanging air flows in a direction perpendicular to the surface plane of the heat exchanger core, which comprises several heat exchanging tube rows. As shown in FIG. 17, an in-tube heat exchanging fluid F is introduced into the heat exchanger core 1 at one side, and the air A enters the heat exchanger core 1 from the opposite side. In each tube row, the two fluids, in-tube fluid F and air A, flow normal to each other, as in a typical crossflow heat exchanger. However, if the flows between each tube row are considered, it will be appreciated that the two fluids A and F flow parallel to each other but in opposite directions, as in a typical counterflow heat exchanger. Overall, the heat exchanger core 1 is therefore considered to have a cross-counterflow arrangement.

Examples of such heat exchangers are disclosed in U.S. Pat. Nos. 4,829,780 and Re. 35,502 (originally 5,157,944), both to Hughes et al.

U.S. Pat. No. 4,829, 780 to Hughes et al. discloses an evaporator which comprises a number of integrally assembled heat exchange modules, each of which comprises a pair of spaced apart headers 12, 14 interconnecting a series of flat hollow heat tubes 40 in a manner to attain a serpentine flow between the headers.

U.S. Pat. Nos. 5,157,944 and Re. 35,502 to Hughes et al. disclose an evaporator including adjacent inlet and outlet headers 10 and 12 and adjacent intermediate headers 14 and 16 spaced apart from headers 10 and 12. Two U-shaped tubes 18 and 19 at the ends of headers 14 and 16 establish communication between the interiors of tubes 18 and 19. A plurality of flattened tubes 20, arranged in two rows, extend between the inlet and outlet headers 10 and 12 at one end and intermediate headers 14 and 16 at the other end.

Most conventional parallel-flow heat exchanges consist of a single row of tubes. In particular, in a conventional parallel-flow heat exchanger, two spaced manifolds or headers are provided, with a plurality of flat tubes fixedly connected therebetween to provide a plurality of fluid flow paths. Corrugated fins are positioned between the tubes. Typically, as least one baffle is positioned in at least one of the manifolds to partition the manifold into at least first and second chambers and redirect the fluid flow path to the other manifold.

When such a heat exchanger is used as a condenser, compressed refrigerant gas from an external compressor is introduced via an inlet pipe into the first chamber of the first manifold, and is distributed so that a portion of the gas flows through each of the flat tubes which is disposed upstream of the baffle, and into one end of the second manifold. The refrigerant flows through the second manifold towards its other end, and is distributed so that a portion of the refrigerant flows through each of the tubes disposed downstream of the baffle, and into the second chamber of the first manifold. As the refrigerant gas flows sequentially through the tubes, heat from the refrigerant gas is exchanged with the atmospheric air flowing through the corrugated fins. The condensed, sub-cooled liquid refrigerant in the second cavity of the first manifold flows out of the second cavity through an outlet pipe connected thereto.

As the heat-exchanging air flows into a single row condenser core of the type described above, it has the ambient atmospheric temperature uniformly on the cross-sectional surface. If the heat-exchanging fluid in a tube is a zeotropic mixture, its phase-changing process is no longer at a constant temperature.

A zeotrope is a mixture fluid made up of two or more types of compounds. Its evaporating and condensing temperatures vary in phase-changing processes. For example, in evaporation, because there is no unique boiling point for each compound, the components in the mixture do not vaporize at rates proportionally to their composition in the liquid state. The more volatile component vaporizes faster and more than the heavier component. Therefore, the more volatile component comprises a higher proportion of the composition in the vapor phase than in the liquid phase.

FIG. 18 shows a two-component zeotropic mixture phase diagram for two compounds A and B, where the compound B is the more volatile of the two components. When a subcooled liquid having the composition shown at point a is heated, the temperature of the mixture rises until it starts boiling, or reaches the "bubble point" (the point at which bubbles begin to appear in the liquid). At the bubble point, the liquid phase composition is read from the point $b_L$ and its vapor phase composition is read from the point $b_V$. During boiling, the more volatile component in the mixture is preferentially vaporized, to increase the composition of the heavier component in the liquid phase, so that the system saturation temperature rises. At the point c, the compositions in both the vapor phase (at $c_V$) and the liquid phase (at $c_V$) are no longer the original values. As the last drop of liquid vaporizes, the mixture reaches the dew point line. This is the temperature at which liquid begins to appear when the zeotropic vapor is cooled. At the dew point, the vapor-phase composition is $d_V$, and the liquid-phase composition is $d_L$. With more heating, the mixture becomes a superheated vapor from d to e. This superheated vapor has the same composition as point a. During evaporation, from the time the first bubble appears to the time the last droplet vaporizes, the system evaporating temperature (or saturation temperature) increases. This increase of the saturation temperature from the bubble point to the dew point is called the "temperature glide." A similar analysis for condensation can be made from the phase diagram of FIG. 18.

The practical effect of the temperature glide in a heat exchanger is that, as shown in FIG. 19, as a mixture flows through the heat exchanger core at constant pressure, the evaporating (or condensing) temperature rises (or drops) from E1 (or C1) at the inlet to E2 (or C2) at the outlet of the evaporator (or condenser). A constant evaporating or condensing temperature process, which exists in the single-component fluid, does not occur in a zeotropic mixture fluid.

Due to temperature glide effects, the temperature differential between air and in-tube fluid at the inlet may be much higher than at the outlet. The temperature differential profile on the entire heat transfer surface could then be highly non-uniform. Similar conclusions can be drawn if the heat exchanger core is used as a zeotropic mixture fluid evaporator or a single-phase fluid heat exchanger, for example, an air-glycol/water radiator, an air-air charge air cooler, and so on. According to presently-known heat exchanger design practice, at certain temperature variation ranges in hot fluid and cold fluid, the more uniform the profile of temperature differentials between hot and cold fluids on the entire heat exchanging surface area, the more efficient is the heat exchanger performance. Therefore, it is necessary to find a way to improve the temperature differential profile in the heat exchanger.

The counterflow arrangement is thermodynamically superior to any other flow arrangement. Ideally, it is the most efficient flow arrangement producing the highest temperature change in each fluid compared to any other two-fluid flow arrangements in an exchanger for a given amount of surface area and fluid flow rates. Thus, we (the present inventors) have introduced the counterflow design concept into current micro-channel heat exchanger design to produce the cross-counterflow concept. However, this cross-counterflow arrangement is practically feasible only for a heat exchanger with a thicker core. This cross-counterflow heat exchanger utilizes the temperature variations in both heat exchange fluids (if any) to improve the heat exchanger performance. For two-phase zeotropic mixture fluids and single-phase fluids, because their temperatures change through the entire heat transfer process, the cross-counterflow concept can reduce the non-uniformity of the temperature differential profile between hot and cold fluids in heat exchangers, and increase the overall heat exchange capacity at the same temperature variation ranges.

This problem is addressed in U.S. Pat. No. 5,174,373 to Shinmura, which discloses a heat exchanger in which the header pipes 11 and 12 are divided into at least two longitudinal chambers by at least one dividing wall which extends in the longitudinal direction. A plurality of flat tubes 13 extend between the header pipes 11 and 12, the flat tubes 13*a* being provided with slits 13*a* at their ends for receiving the peripheral surfaces of the dividing wall. The flat tubes have a plurality of fluid paths 9 formed by a plurality of longitudinal partitions 8. Baffles can be provided in the header pipes to change the flow path.

U.S. Pat. No. 5,203,407 to Nagasaka discloses a heat exchanger having spaced apart headers which redirect flow from groups of tubes back and forth between the headers, the headers having both longitudinal and transverse partitions which divide the headers into a plurality of longitudinal passages. In the embodiment of FIGS. 16 and 17, the header 40 comprises a tank 15 diametrically divided to form a pair of sub-passages 8 and 12, and an end plat 16 which cooperates with the tank 15 to form a main passage 34. The sub-passage 8 serves as a distributing chamber and the sub-passage 12 serves as a collecting chamber. The header can also be formed by extrusion as shown in FIG. 18 to form three passages.

U.S. Pat. No. 5,228,315 to Nagasaka et al. also discloses a heat exchanger with multi-passage headers. These headers can be extruded, with as many as five passages.

U.S. Pat. No. 31,444 to Cragg et al. discloses a steam boiler condenser having groups of parallel tubes mounted between a pair of headers which redirect flow back and forth between the headers.

U.S. Pat. No. 3,181,525 to McKann discloses a group of parallel tubes having manifolds on each end, the manifolds being provided with dividing walls for redirecting the flow back and forth between the manifolds.

U.S. Pat. No. 3,675,710 to Ristow discloses parallel groups of tubes mounted between headers 11 and 12, the headers 11 and 12 being provided with transverse partitions 18 for redirecting the heat exchange fluid back and forth between the headers. The headers 11 and 12 are also provided with longitudinally-extending condensate drain pipes 29 extending between holes in the partitions 18 for to drain condensate as it forms in the tubes.

U.S. Pat. No. 4,190,101 to Hartmann discloses a heat exchanger having parallel tubes between a pair of headers, one of which has a wall divider 21 for directing a portion of the total flow out of the tubes down to the other header where the flow is returned to the other set of tubes.

U.S. Pat. Nos. 5,086,835 and 5,176,200 to Shinmura disclose a heat exchanger which comprises a number of integrally assembled heat exchanger cores, each of which comprises a pair of spaced apart headers interconnecting a series of flat hollow heat tubes 13, 23 in a manner to attain a serpentine flow between the headers.

U.S. Pat. No. 5,186,248 to Halstead discloses a heat exchanger, e.g. a condenser, which includes a pair of spaced apart tanks, one of which is a unitary extrusion 30, 130 which forms a longitudinally-extending main tank 32, 132 and a longitudinally-extending outlet tank 34, 134; while the other has only a single return tank 42, 142 formed therein.

U.S. Pat. No. 5,348,081 to Halstead et al. discloses a condenser which comprises two layers assembled heat exchange modules, each of which comprises a pair of spaced apart headers 14, 16 interconnecting a series of flat hollow heat tubes 18 in a manner to attain a serpentine flow between the headers. The headers 14 can be connected by a cross-over pipe 40.

U.S. Pat. No. 5,400,853 to Wolters discloses a heat exchanger in which one of the manifolds 16 includes a return chamber 28 from which a return tube 30 extends the remainder of the length of the manifold.

U.S. Pat. No. 5,582,239 to Tsunoda et al. discloses a heat exchanger in which the first tank includes a first partition which divides it into at least two chambers and the second tank includes a second partition which divides it into one fewer chambers than the first tank. The partitions can extend both transversely and longitudinally.

None of the above-discussed prior art addresses the problem of undue size in heat exchangers such as those disclosed by Hughes et al. comprising more than three or four integrally assembled heat exchange modules; or how extruded and/or multiple passage manifolds such as those used in conventional parallel flow heat exchangers, can be applied to reducing the size of cross-counterflow heat exchangers.

Further, none of the above-discussed multi-row, cross-counterflow heat exchangers can eliminate air gaps between each heat exchanger row or module. The heat exchanger design disclosed in U.S. Pat. No. 5,174,373 to Shinmura has no air gap between rows, but the theory on which the design is based restricts the design to the two-row case. Through numerical analysis and experimental tests, we know that the air gap between rows can cause an additional pressure drop. The air gap also can trap solid particles and other material, which block the air flow paths and cannot easily be removed or cleaned out, and thereby reduce heat exchanger performance. In addition, the air gap increases the heat exchanger core thickness.

It is to the solution of these and other problems to which the present invention is directed.

SUMMARY OF THE INVENTION

It is a primary object of the invention to provide a heat exchanger which employs the cross-counterflow concept to reduce non-uniformity of temperature differential profile between the hot and cold fluids moving therethrough.

It is another object of the invention to provide a cross-counterflow heat exchanger in which the number of passes can be increased without unduly increasing the size.

In is still another object of the invention to provide a cross-counterflow heat exchanger in which air gaps are eliminated.

It is still another object of the invention to provide a manifold for a multi-pass cross-counterflow heat exchanger which can be formed by extrusion.

It is still another object of the invention to provide a manifold for a multi-pass cross-counterflow heat exchanger which can be configured in a variety of geometries.

These and other objects are achieved by the provision of a cross-counterflow heat exchanger comprising a pair of identical and identically-oriented, spaced manifolds, a plurality of parallel heat exchanger tubes extending between the manifolds, and conventional heat exchanger fins positioned between adjacent heat exchanger tubes. Each of the manifolds has an interior surface, an interior defined by the interior surface, and an interior, longitudinally-extending dividing wall. Each of the heat exchanger tubes is divided into a plurality of passages and each of the tubes has first and second ends, one end being inserted into the interior of each of the manifolds.

In a 2n pass heat exchanger, each manifold is symmetric about a mirror plane, the dividing wall is configured to define n+1 upper channels and n lower channels, and the passages of the heat exchanger tubes are divided into 2n flow paths, n being a positive integer. In a 2n+1 pass heat exchanger, each manifold is symmetric about a rotation axis, the dividing wall is configured to define n+1 upper channels and n+1 lower channels, and the passages of the heat exchanger tubes are divided into 2n+1 flow paths, n again being a positive integer.

Further, in a 2n pass heat exchanger, the dividing wall of each of the manifolds includes 2n−1 vertical webs, each of the heat exchanger tubes includes 2n−1 partitions dividing the passages into 2n flow paths; while in a 2n+1 heat exchanger, the dividing wall of each of the manifolds includes including 2n vertical webs, each of the heat exchanger tubes includes 2n partitions dividing the passages into 2n+1 flow paths. When the number of vertical webs is greater 1 (that is, when n>1 ), the vertical webs alternately extend from opposite interior surfaces of the manifold. In both 2n and 2n+1 pass heat exchangers, the partitions of the heat exchanger tubes have notches at both ends for engaging the vertical sections of the manifolds.

In one aspect of the invention, the dividing wall includes two transverse webs extending outwardly from each vertical web. These transverse webs can be configured as, for example, planar webs extending diagonally in opposite directions to form a zig-zag pattern (a series of interlocking, alternatingly-oriented Y-shapes), as coplanar webs, or as reverse curves forming a sinusoidal pattern.

In another aspect of the invention, different manifold geometries can be used, as long as they conform to the general symmetry requirements of the invention, the particular manifold geometry being determined primarily by the shape of the envelope in which the heat exchange is to fit, and the required burst pressure of the manifolds. The ease of machining the tube slots may also be a consideration. Examples of manifold geometries include, but are not limited to circular, oval, flattened oval, and rectangular.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which:

FIG. 10 is a cross-sectional view of a third embodiment of a heat exchanger in accordance with the present invention.

FIG. 11 is a cross-sectional view, taken on line 11—11 of FIG. 10.

FIG. 12 is an end elevational view of one of the manifolds of FIG. 10.

DETAILED DESCRIPTION OF THE PREFERRED EMBODIMENTS

Figure 1:
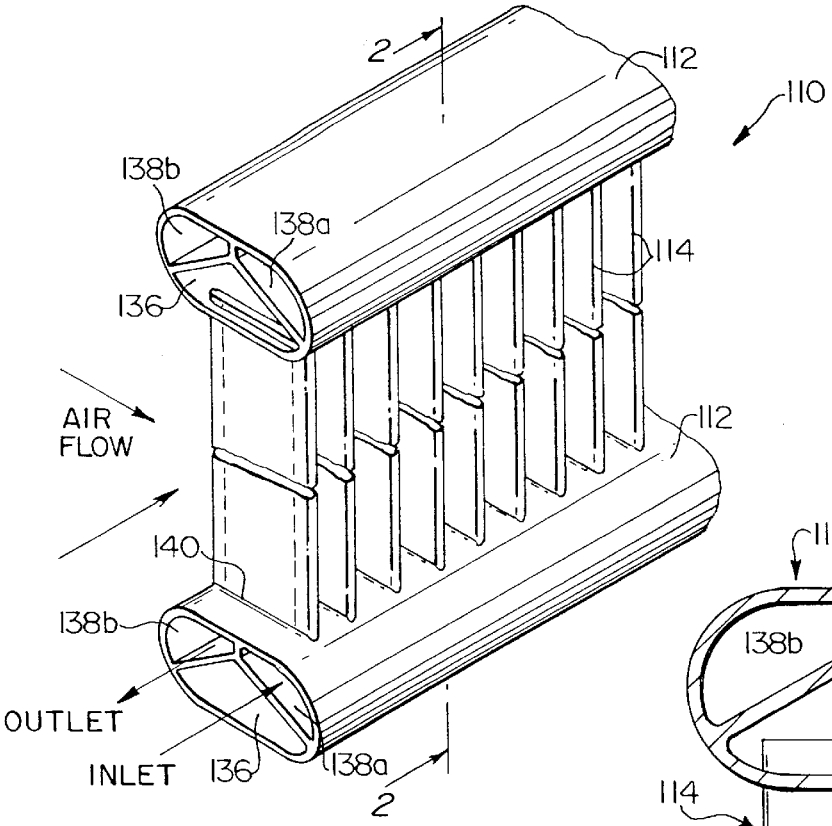
FIG. 1 is a perspective view of first embodiment of an assembled cross-counterflow heat exchanger in accordance with the present invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Figure 2:
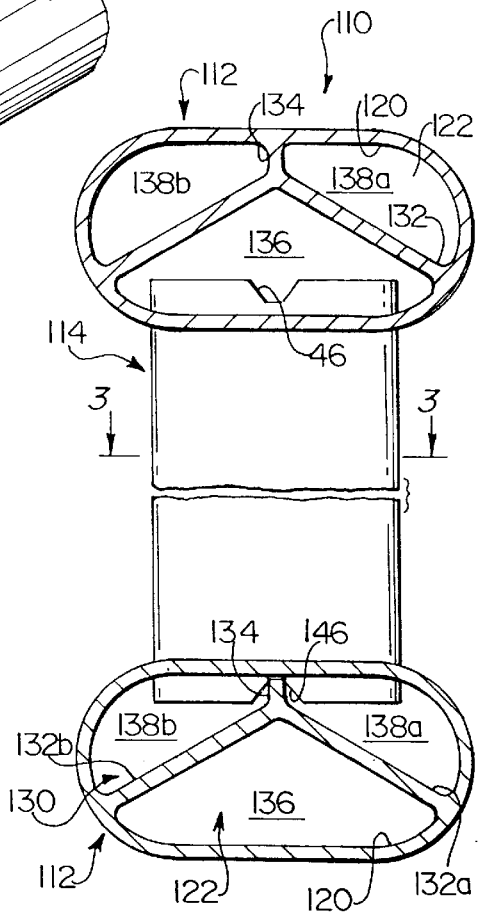
FIG. 2 is a cross-sectional view of the heat exchanger of FIG. 1, taken on line 2—2 of FIG. 1.

Referring now to FIGS. 1 and 2, there is a first embodiment of a cross-counterflow heat exchanger 110 in accordance with the present invention, incorporating a pair of spaced, extruded manifolds 112 formed with multiple passages, in conjunction with a plurality of parallel, spaced heat exchanger tubes 114. Conventional heat exchanger fins (not shown) are positioned between the heat exchanger tubes 114, in the manner shown in, for example, U.S. Pat. Nos. 5,157,944 and 5,228,315.

In the first embodiment, each of the manifolds 112 is of the flattened oval type (that is, the upper and lower surfaces are planar, and the side surfaces are semi-cylindrical) having in transverse cross-section a major axis parallel to and equidistant from the upper and lower surfaces and a minor axis perpendicular to and bisecting the major axis. However, as will be discussed in greater detail hereinafter, the manifold geometry of the present invention is not limited to the flattened oval type; other manifold geometries can be used.

As can be seen from FIGS. 1 and 2, each of the manifolds 112 in the first embodiment of the invention has an interior surface 120, an interior 122 defined by the interior surface 120, and an interior dividing wall 130 having in transverse cross-section a Y-shape which, as the heat exchanger 110 is oriented in FIGS. 1 and 2, is inverted. That is, each dividing wall 130 comprises three intersecting webs, two of which, designated by reference numerals 132*a* and 132*b*, extend diagonally from the semi-cylindrical sides of the manifold 112 to a point of intersection inwardly of one planar wall, and one of which, designated by reference numeral 134, extends vertically from the planar to the point of intersection of the other two webs 132*a* and 132*b*.

The dividing wall 130 extends the entire length of each manifold 112, and divides the interior 122 into a lengthwise lower chamber 136 defined between the diagonal webs 132*a* and 132*b* of the Y-shape and the interior surface 120, and two lengthwise upper chambers 138*a* and 138*b*, one chamber 138*a* being defined between the diagonal web 132*a*, the vertical web 134, and the interior surface 120, and the other chamber 138*b* being defined between the diagonal web 132*b*, the vertical web 134, and the interior surface 120. The orientation of both manifolds 112 in the assembled heat exchanger 110 is the same.

It is to be understood that "upper" and "lower" as used in the present application are arbitrary, inasmuch as a heat exchanger in accordance with the present invention can be oriented in different directions. Therefore, "upper" and "lower" should be understood to be used with reference to the orientation of the heat exchangers and/or manifolds as shown in the drawings herein, and as not limiting the orientation of the heat exchangers and/or manifolds in actual use.

Figure 4:
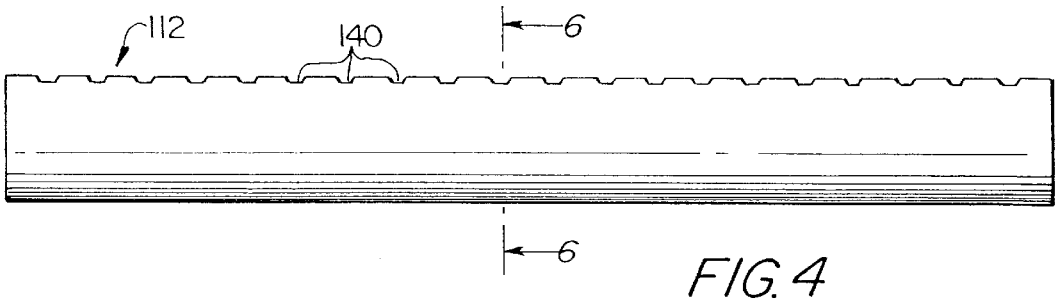
FIG. 4 is a side elevational view of the lower manifold of the heat exchanger of FIG. 1.
Figure 5:
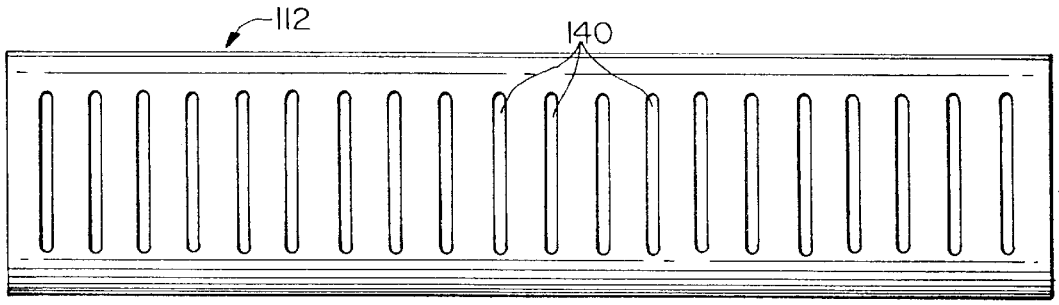
FIG. 5 is a top plan view of the manifold of FIG. 4.
Figure 6:
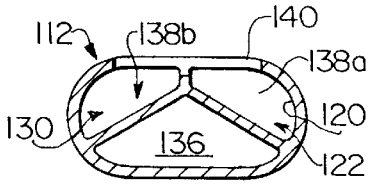
FIG. 6 is a cross-sectional view of the manifold taken on line 6—6 of FIG. 4.

As shown in FIGS. 4–6, each of the manifolds 112 is provided with a plurality of parallel, spaced tube slots 140 for receiving the heat exchanger tubes 114. The tube slots 140 can be formed by conventional machining methods.

Figure 3:
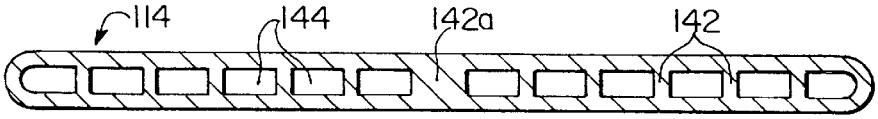
FIG. 3 is a cross-section, taken on line 3—3 of FIG. 2.

As shown in FIG. 3, the heat exchanger tubes 114 are of the flat, extruded type formed with a plurality of parallel, spaced partitions 142 defining multiple passages 144, as disclosed in U.S. Pat. No. 5,174,373 to Shinmura, which is incorporated herein by reference. The center partition 142*a* is thicker than the other partitions 142, and serves to divide the passages 144 into first and second flow paths. At least one of the ends of each of the tubes 114 has a notch 146 formed in the center partition 142*a*, which notch 146 is configured to receive the vertical web or section 134 of the dividing wall 130. Preferably, both ends of each of the tubes 114 has a notch 146, so that the tubes 114 can be assembled to the manifolds 112 without regard to their orientation.

The number and size of the passages 144 are dependent on engineering considerations for the specific application, as well be understood by those of skill in the art.

As will be appreciated from consideration of FIGS. 2 and 3, due to the structure and orientation of the manifolds 112 and the manner in which they receive the ends of the tubes 114 (and particularly, the manner in which the vertical web 134 of the lower manifold 112 engages the notch 146 in the lower end of the tubes 114), both flow paths of each tube 114 are in communication with the lower chamber 136 of the upper manifold 112, while the first and second flow paths are in communication with the upper chambers 138*a* and 138*b*, respectively of the lower manifold 112.

A single heat exchanger 110 in accordance with the first embodiment, in which each of the manifolds 112 has a lengthwise lower chamber 136 and two lengthwise upper chambers 138*a* and 138*b*, replaces a two-module heat exchanger of the type disclosed by Hughes et al. In use, compressed refrigerant gas from an external compressor is introduced via an inlet pipe into a first one of the two lengthwise upper chambers 138*a* and 138*b* of the lower manifold 112 (which as illustrated in FIGS. 1 and 2 is the right upper chamber 138*a*, and is henceforth referred to as the inlet chamber). As shown by the arrows, the gas will flow from the inlet chamber 138*a* upwardly into those passages 144 of the heat exchanger tubes 114 in the first flow path, then into the lower chamber 136 of the upper manifold, then down through the second flow path into the second upper chambers 138*b* of the lower manifold 112, and finally out of the second upper chamber 138*b* of the lower manifold 112 through an outlet pipe connected thereto. Air flows across the heat exchanger 110 in a direction from the outlet side of the lower manifold 112 to the inlet side.

As will be appreciated from the preceding description, wasted refrigerant is eliminated, because refrigerant is only carried by a portion of the manifold volume, that is, by the passages which are in communication with the heat exchanger tubes 114: lower passage 136 of the upper manifold 112 and by upper passages 138*a* and 138*b* of the lower manifold 112.

In a conventional cross-counterflow heat exchanger, as many modules as are required by the particular application can be assembled, within the limits permitted by the space available. The extruded manifolds 112 in accordance with the present invention can be configured to replace the multiple manifolds in a conventional, multi-module cross-counterflow heat exchanger, thus providing a cross-counterflow heat exchanger 110 which is easier to assemble and is more compact than the conventional type.

Figure 7:
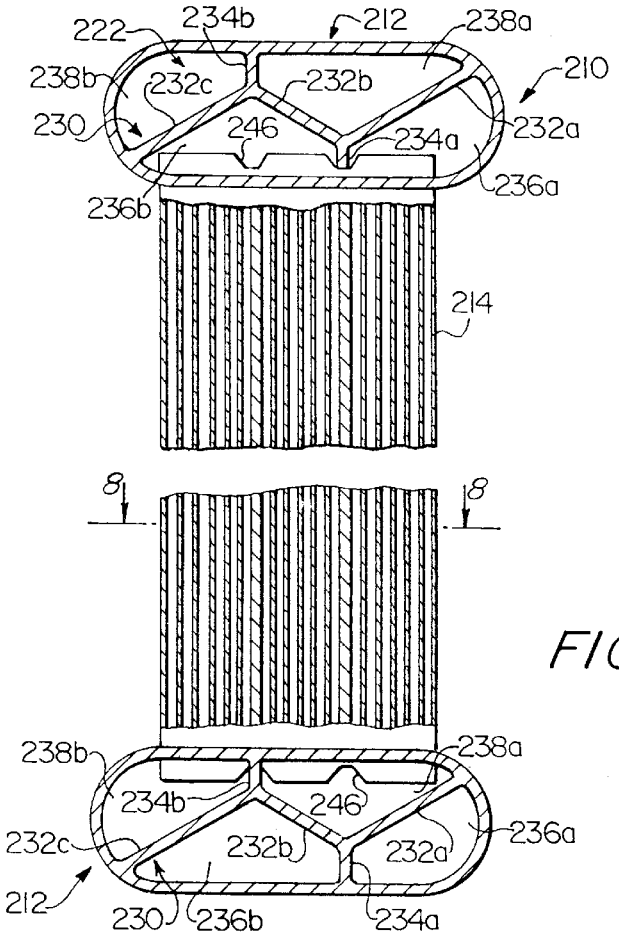
FIG. 7 is a cross-sectional view of a second embodiment of a heat exchanger in accordance with the present invention.

The number of passes in a cross-counterflow heat exchanger in accordance with the present invention can be increased by adding diagonal and vertical sections to the interior dividing wall. A second embodiment of the invention, shown in FIG. 7, provides a three-pass circuit which replaces a conventional three-row cross-counterflow heat exchanger. The cross-counterflow heat exchanger 210 shown in FIG. 7 comprises a pair of spaced manifolds 212 having a plurality of parallel, spaced heat exchanger tubes 214 extending therebetween as in the first embodiment. As in the first embodiment, the manifolds 212 are of the flattened oval type having in transverse cross-section a major axis, a minor axis, and a center at the intersection of the major and minor axes. Also as in the first embodiment, the manifold geometry is considered exemplary, other geometries being possible as discussed hereinafter. Conventional heat exchanger fins (not shown) are positioned between the heat exchanger tubes 214.

Figure 8:
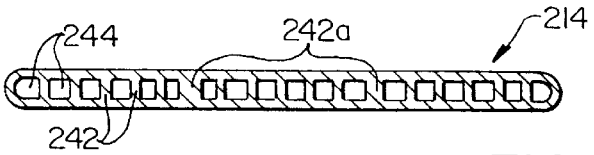
FIG. 8 is a cross-sectional view, taken on line 8—8 of FIG. 7.
Figure 9:
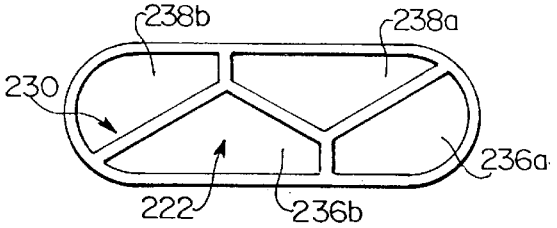
FIG. 9 is an end elevational view of one of the manifolds of FIG. 7.

As best shown in FIG. 8, the interior 222 of each of the manifolds 212 is divided by a dividing wall 230 into two lengthwise lower chambers 236*a* and 236*b* and two lengthwise upper chambers 238*a* and 238*b* by an interior dividing wall 230 extending the entire length of each of the manifolds 212 and having a transverse cross-section in the form of two oppositely-oriented, superimposed Y-shapes. In other words, the dividing wall 230 of each manifold 210 has in transverse cross-section three diagonal webs or sections 232*a*, 232*b*, and 232*c* which are alternately oriented in a zig-zag pattern extending from the semi-cylindrical sides of the manifold 212 to two points of intersection inwardly of opposite planar walls, and vertical webs or sections 234*a* and 234*b* joining the points of intersection to the opposite planar walls. As in the heat exchanger 110 of the first embodiment, the orientation of both manifolds 212 of the second embodiment is the same.

In each of the manifolds 212, the lower chamber 236*a* is defined between the diagonal web 232*a*, the vertical web 234*a*, and the interior surface 220 of the manifold. The lower chamber 236*b* is defined between the diagonal webs 232*b* and 232*c*, the vertical web 234*a*, and the interior surface 220. The upper chamber 238*a* is defined between the diagonal webs 232*a* and 232*b*, the vertical web 234*b*, and the interior surface 220. The upper chamber 238*b* is defined between the diagonal web 232*c*, the vertical web 234*b*, and the interior surface 220.

Referring now to FIGS. 7 and 8, the heat exchanger tubes 214 are similar to heat exchanger tubes 114, having a plurality of parallel, spaced partitions 242 defining multiple passages 244, except that heat exchanger tubes 214 have two partitions 242*a* spaced from each other and from the tube sides which are thicker than the other partitions 242, and which serve to divide the passages 244 into first, second and third flow paths. Both ends of each of the tubes 214 have notches 246 formed in the thickened partitions 242*a*, which notches 246 are positioned and configured to receive the vertical webs 234*a* and 234*b* of the dividing wall 230.

As in the first embodiment, the number and size of the passages 244 are dependent on engineering considerations for the specific application.

As can be seen from FIG. 7, due to the structure and orientation of the manifolds 212 and the manner in which they receive then ends of the tubes 214, a compressed refrigerant gas introduced into the heat exchanger 210 through the lower chamber 236*a* of the upper manifold 212 will flow down the passages 244 of the first flow path into the upper chamber 238*a* of the lower manifold 212, then up through the passages 244 of the second flow path into the lower chamber 236*b* of the upper manifold 212, and then down through the passages 244 of the third flow path into the upper chamber 238*b* of the lower manifold 212 and out of the heat exchanger 210. It is noted that, unlike in the first embodiment, the inlet and outlet in the second embodiment are in different manifolds 212. However, as in the first embodiment, air flows across the heat exchanger 210 of the second embodiment in a direction from the outlet side to the inlet side.

As will be appreciated from examination of FIGS. 2 and 7, the dividing walls are always configured such that the passages adjacent each of the semi-cylindrical sides are always bounded by one diagonal section and one vertical section, whereas the passages adjacent each of the planar sides are always bounded by two diagonal sections, such that the two passages adjacent the semi-cylindrical sides have a smaller cross-section than the passages adjacent the planar sides. This relationship holds true, regardless of the number of passes in the heat exchanger. Also, regardless of the number of passes in the heat exchanger, the inlet is always in one of the two smaller passages (that is, one of the passages adjacent one of the semi-cylindrical sides) of one of the manifolds. However, in a heat exchanger having an even number of passes, the inlet and outlet are always on opposite sides of the same manifold, wherein in a heat exchanger having an odd number of passes, the inlet and outlet are always on opposite sides of different manifolds.

An example of a third embodiment of a heat exchanger in accordance with the present invention, which replaces a four-module conventional heat exchanger, is shown in FIG. 10. Referring now to FIG. 10, like the first embodiment, the third embodiment of the heat exchanger 310 incorporates a pair of spaced, extruded manifolds 312 formed with multiple passages, in conjunction with a plurality of parallel, spaced heat exchanger tubes 314 extending between the manifolds 312, and conventional heat exchanger fins (not shown) positioned between the heat exchanger tubes 314.

Each of the manifolds 312 is of the flattened oval type. As can be seen from FIGS. 8 and 10, each of the manifolds 312 in the third embodiment of the invention has an interior surface 320, an interior 322 defined by the interior surface 320, an interior dividing wall 330 having a transverse cross-section in the shape of three oppositely-oriented, superimposed Y-shapes. In other words, the dividing wall 330 of each manifold 310 has in transverse cross-section four diagonal webs or sections 332*a*, 332*b*, 332*c*, and 332*d* which are alternately oriented in a zig-zag pattern extending from the semi-cylindrical sides of the manifold 312 to three points of intersection inwardly of alternating planar walls, and three vertical webs or sections 334*a*, 334*b*, and 334*c* joining the points of intersection to the opposite planar walls. As in the heat exchangers 110 and 210 of the first and second embodiments, the orientation of both manifolds 312 of the third embodiment is the same.

As best shown in FIG. 12, the dividing wall 330 extends the entire length of each manifold 312, and divides the interior 322 into two lengthwise lower chambers 336*a* and 336*b* defined between the webs of the adjacent Y-shapes and the interior surface 320, and three lengthwise upper chambers 338*a*, 338*b*, and 338*c* defined between the webs and the bases of the adjacent Y-shapes and the interior surface 320. As in the first and second embodiments, the orientation of both manifolds 312 is the same.

Also as in the first embodiment, each of the manifolds 312 is provided with a plurality of parallel, spaced tube slots (not shown) for receiving the heat exchanger tubes 314. These tube slots are formed in the same manner as the tube slots of the first embodiment.

As shown in FIG. 11, the heat exchanger tubes 314 of the second embodiment are of the flat, extruded type, formed with a plurality of parallel, spaced partitions 342 defining multiple parallel, fluid flow passages 344. In the third embodiment, three of the partitions 342*a*, 342*b*, and 342*c* are spaced to align with the vertical webs 346*a*, 346*b*, and 346*c* and are thicker than the other partitions 342 for engagement with the vertical webs 346*a*, 346*b*, and 346*c*. The center notch 346*b* at the upper end of each tube 314 thus can receive the center vertical web or section 334*b*; while the side notches 346*a* and 334*c* at the lower end of each tube 314 can receive the side vertical webs or sections 334*a* and 334*c*.

As will be appreciated from examination of FIGS. 2, 7, and 10, each of the manifolds of a heat exchanger having an even number of passes is symmetric about a rotation axis extending lengthwise through the intersection of the manifold major and minor axes; while each of the manifolds of a heat exchanger having an odd number of passes is symmetric about a mirror plane extending lengthwise through the manifold minor axis. These symmetries enable a single extrusion to be used for both manifolds of a heat exchanger in accordance with the present invention; enable both manifolds of a heat exchanger to have the same orientation when used in conjunction with multipassage heat exchanger tubes of the type disclosed in U.S. Pat. No. 5,174,373 to Shinmura; and enable passages to be provided through which refrigerant does not flow, thus eliminating refrigerant waste. Further, symmetrical geometries tend to resist bowing during extrusion, and extrude straight.

Figure 13:
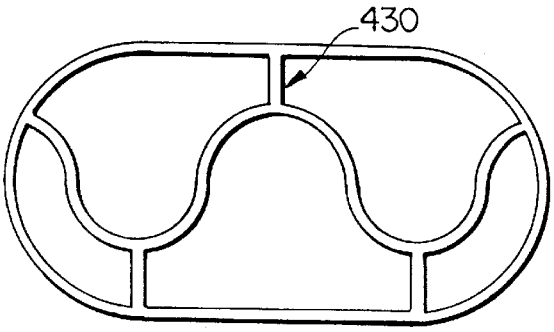
FIG. 13 is an end elevational view of a manifold for a fourth embodiment of a heat exchanger in accordance with the present invention.
Figure 14:
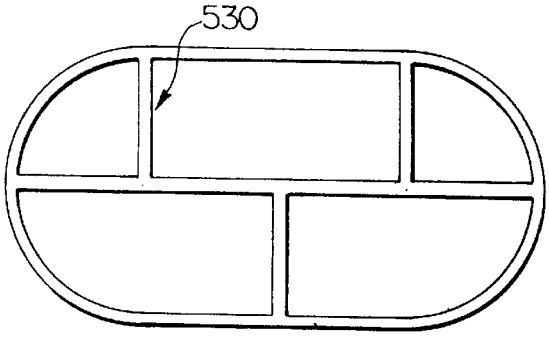
FIG. 14 is an end elevational view of a manifold for a fifth embodiment of a heat exchanger in accordance with the present invention.

As will further be appreciated, the diagonal webs can be modified from the zig-zag configuration illustrated in FIGS. 2, 7, and 10 into other patterns which will provide the requisite symmetry about an axis of rotation or mirror plane while also providing the requisite number of alternating upper and lower passages. In general, the webs forming the dividing wall either extend transversely, so as to divide the manifold into upper and lower portions, or vertically, so as to divide the upper and lower portions into separate passages and also engage the heat exchanger tubes. For example, as shown in FIG. 13, the dividing wall 430 can be formed with the transverse webs configured as reverse curves to provide a sinusoidal pattern, with the vertical webs extending out from the crest of each curve. As shown in FIG. 14, the dividing wall 530 can be configured with aligned planar transverse webs, and with the vertical webs extending out from alternate sides. Regardless of whether the transverse webs are diagonal, sinusoidal, coplanar, or some other configuration, every dividing wall has at least one vertical web and every vertical web has two transverse webs extending outwardly therefrom in opposite directions; and for heat exchangers having more than two passes (that is, having more than one vertical web), alternate vertical webs extend from opposite planar walls of the manifold.

It will be appreciated by those of skill in the art that depending upon the requirements of the system in which the heat exchanger is to be used, the width of the manifolds and the heat exchanger tubes can be adjusted to accommodate any number of passes, and thus any number of upper chambers and associated lower chambers. To increase the number of passes, the number of transverse and vertical webs is increased by one each for each pass to be added. The heat exchanger tubes are also accordingly widened, adding additional partitions and passages, the partitions in alignment with the vertical sections of the manifold dividing walls being thickened and notched as previously described in connection with the first, second, and third embodiments.

In general, a cross-counterflow heat exchanger in accordance with the present invention which has an even number of passes 2n replaces a conventional cross-counterflow heat exchanger having 2n rows, while a cross-counterflow heat exchanger in accordance with the present invention which has an odd number of passes 2n+1 replaces a conventional cross-counterflow heat exchanger having 2n+1 rows, n being a positive integer. In a 2n pass heat exchanger in accordance with the present invention, the manifolds are symmetric about a mirror plane and are provided with dividing walls including 2n−1 vertical sections and configured to define n+1 upper channels and n lower channels, and the passages of the heat exchanger tubes are divided into 2n flow paths by 2n−1 notched partitions, n being a positive integer. In a 2n+1 pass heat exchanger in accordance with the present invention, the manifolds are symmetric about a rotation axis and are provided with dividing walls including 2n vertical sections and configured to define n+1 upper channels and n+1 lower channels, and the passages of the heat exchanger tubes are divided into 2n+1 flow paths by 2n notched partitions, n again being a positive integer.

With this cross-counterflow design in accordance with the present invention, the parallel flow heat exchanger can be made to utilize temperature variations in single-phase heat transfer, and two-phase zeotropic mixtures heat transfer.

Figure 15:
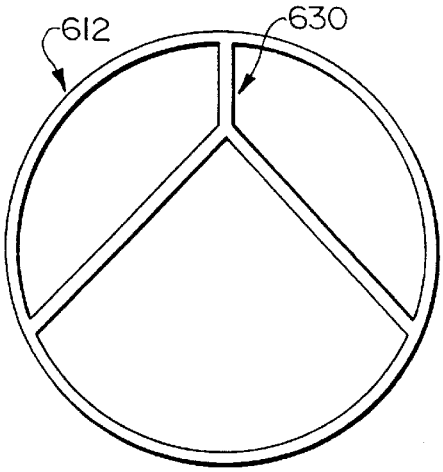
FIG. 15 is an end elevational view of a manifold for a sixth embodiment of a heat exchanger in accordance with the present invention.
Figure 16:
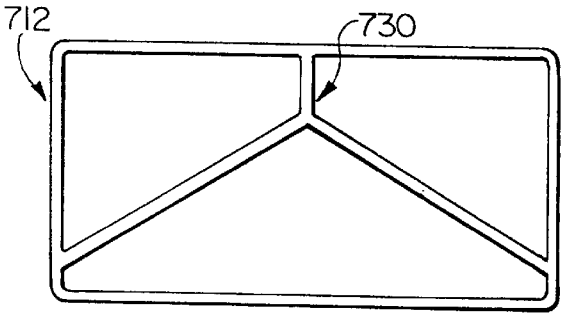
FIG. 16 is an end elevational view of a manifold for a seventh embodiment of a heat exchanger in accordance with the present invention.
Figure 17:
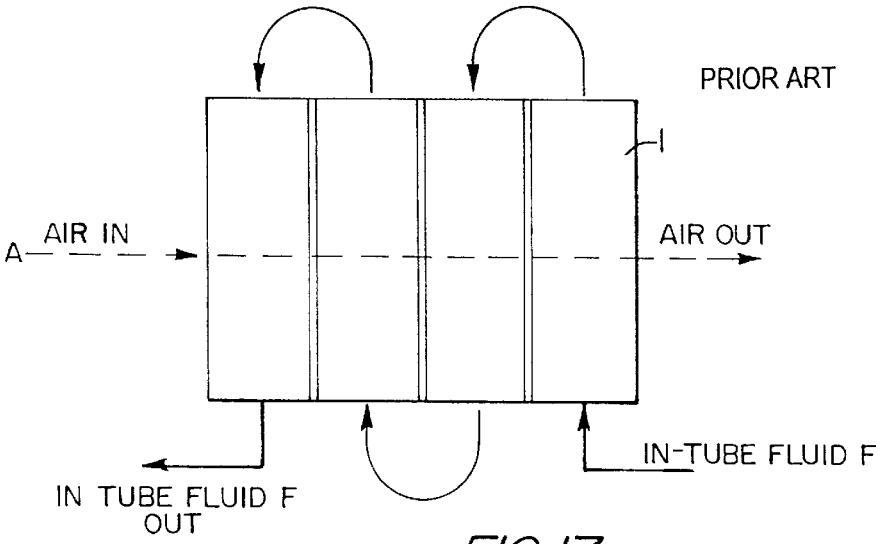
FIG. 17 is a diagrammatic representation of a conventional (prior art) four-row, cross-counterflow arrangement, showing the direction of air and in-tube fluid therethrough.
Figure 18:
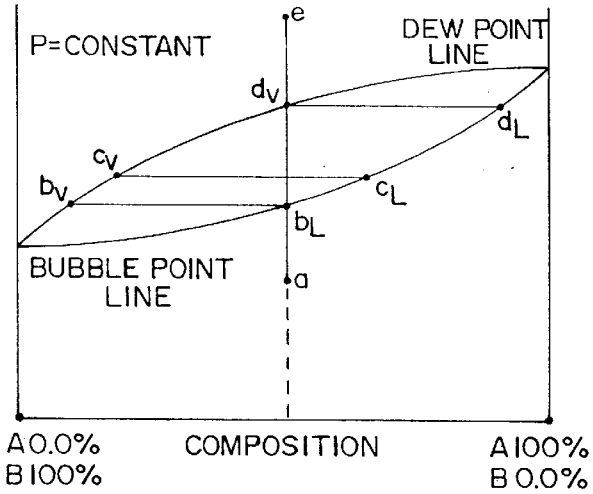
PRIOR ART FIG. 18
FIG. 18 shows a zeotropic two-phase mixture phase diagram.
Figure 19:
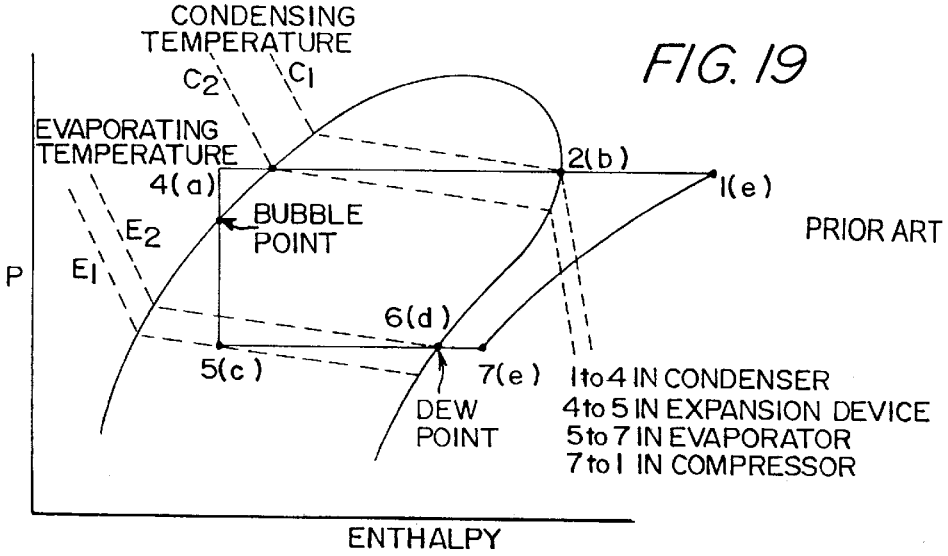
FIG. 19 PRIOR ART
FIG. 19 is a graph showing the change in the evaporating (or condensing) temperature with compositions in the liquid and vapor phases.

Modifications and variations of the above-described embodiments of the present invention are possible, as appreciated by those skilled in the art in light of the above teachings. For example, as mentioned above, different manifold geometries can be used, as long as they conform to the general symmetry requirements of the invention, the particular manifold geometry being determined primarily by the shape of the envelope in which the heat exchange is to fit, and the required burst pressure of the manifolds. The ease of machining the tube slots may also be a consideration. Examples of other manifold geometries include, but are not limited to circular, oval, and rectangular. A circular cross-section manifold 612 for a two-pass heat exchanger is shown in FIG. 15; while a rectangular cross-section manifold 712 for a two-pass heat exchanger is shown in FIG. 16. In the manifolds 612 and 712 illustrated respectively in FIGS. 15 and 16, the dividing walls 630 and 730 have a Y-shaped cross-section. However, as discussed above, other dividing wall geometries (such as those shown in FIGS. 13 and 14) can be used. Further, the dividing walls for all these manifold geometries can be adapted to different numbers of passes, as discussed above.

It is therefore to be understood that, within the scope of the appended claims and their equivalents, the invention may be practiced otherwise than as specifically described.

What is claimed is:

1. A cross-counterflow heat exchanger comprising:

a pair of identical and identically-oriented, spaced manifolds, wherein each of said manifolds has an interior surface, an interior defined by said interior surface, and an interior, longitudinally-extending dividing wall; and a plurality of parallel heat exchanger tubes extending between said manifolds, wherein each of said tubes is divided into a plurality of passages and each of said tubes has first and second ends, one said end being inserted into said interior of one of said manifolds;

wherein in a 2n pass heat exchanger, each said manifold is symmetric about a mirror plane and said dividing wall is configured to define n+1 upper channels and n lower channels, and said passages of said heat exchanger tubes are divided into 2n flow paths, and in a 2n+1 pass heat exchanger, each said manifold is symmetric about a rotation axis and said dividing wall is configured to define n+1 upper channels and n+1 lower channels, and said passages of said heat exchanger tubes are divided into 2n+1 flow paths, n being a positive integer.

2. The heat exchanger of claim 1, wherein in a 2n pass heat exchanger, said dividing wall of each of said manifolds includes 2n vertical webs, wherein in a 2n+1 pass heat exchanger, said dividing wall of each of said manifolds includes 2n vertical webs, and wherein when n>1, said vertical webs alternately extend from opposite sides of said interior surface of each of said manifolds.

3. The heat exchanger of claim 2, wherein said dividing wall of each of said manifolds also includes a transversely extending portion, said transversely extending portion comprising planar webs extending diagonally in opposite directions from each of said vertical webs to form a zig-zag pattern.

4. The heat exchanger of claim 2, wherein said dividing wall of each of said manifolds also includes a transversely extending portion, said transversely extending portion comprising coplanar webs extending in opposite directions from each of said vertical webs.

5. The heat exchanger of claim 2, wherein said dividing wall of each of said manifolds also includes a transversely extending portion, said transversely extending portion comprising reverse curves extending in opposite directions from each of said vertical webs to form a sinusoidal pattern.

6. The heat exchanger of claim 2, wherein said heat exchanger is a two-pass heat exchanger and wherein said dividing walls have a Y-shaped cross-section.

7. The heat exchanger of claim 1, wherein said manifolds have a flattened oval cross-section.

8. The heat exchanger of claim 1, wherein said manifolds have a circular cross-section.

9. The heat exchanger of claim 1, wherein said manifolds have a rectangular cross-section.

10. The heat exchanger of claim 1, wherein in a 2n pass heat exchanger, said dividing wall of each of said manifolds includes 2n vertical webs, each of said heat exchanger tubes includes 2n−1 partitions dividing said passages into 2n flow paths, and said partitions have notches at both ends for engaging said vertical webs of said dividing walls of said manifolds;

wherein in a 2n+1 pass heat exchanger, said dividing wall of each of said manifolds includes 2n vertical webs, each of said heat exchanger tubes includes 2n−1 partitions dividing said passages into 2n flow paths, and said partitions have notches at both ends for engaging said vertical webs of said dividing walls of said manifolds; and wherein when n>1, said vertical webs alternately extend from opposite sides of said interior surface of each of said manifolds.

11. A manifold for a cross-counterflow heat exchanger having 2n passes, n being a positive integer, said manifold having an interior surface, an interior defined by said interior surface, and an interior, longitudinally-extending dividing wall, wherein:

said manifold is symmetric about a mirror plane and said dividing wall is configured to define n+1 upper channels and n lower channels.

12. The manifold of claim 11, wherein said dividing wall of said manifold includes 2n vertical webs, and wherein when n>1, said vertical webs alternately extend from opposite sides of said interior surface of said manifold.

13. The manifold of claim 12, wherein said dividing wall of said manifold also includes a transversely extending portion, said transversely extending portion comprising planar webs extending diagonally in opposite directions from each of said vertical webs to form a zig-zag pattern.

14. The manifold of claim 12, wherein said dividing wall of said manifold also includes a transversely extending portion, said transversely extending portion comprising coplanar webs extending in opposite directions from each of said vertical webs.

15. The manifold of claim 12, wherein said dividing wall of said manifold also includes a transversely extending portion, said transversely extending portion comprising reverse curves extending in opposite directions from each of said vertical webs to form a sinusoidal pattern.

16. The manifold of claim 12, wherein n=1, and wherein said dividing wall has a Y-shaped cross-section.

17. The manifold of claim 11, wherein said manifold has a flattened oval cross-section.

18. The manifold of claim 11, wherein said manifold has a circular cross-section.

19. The manifold of claim 11, wherein said manifold has a rectangular cross-section.

20. A manifold for a cross-counterflow heat exchanger having 2n−1 passes, n being a positive integer, said manifold having an interior surface, an interior defined by said interior surface, and an interior, longitudinally-extending dividing wall, wherein:

said manifold is symmetric about a rotation axis and said dividing wall is configured to define n+1 upper channels and n+1 lower channels.

21. The manifold of claim 20, wherein said dividing wall of said manifold includes 2n vertical webs, and wherein when n>1, said vertical webs alternately extend from opposite sides of said interior surface of said manifold.

22. The manifold of claim 21, wherein said dividing wall of said manifold also includes a transversely extending portion, said transversely extending portion comprising planar webs extending diagonally in opposite directions from each of said vertical webs to form a zig-zag pattern.

23. The heat exchanger of claim 21, wherein said dividing wall of said manifold also includes a transversely extending portion, said transversely extending portion comprising coplanar webs extending in opposite directions from each of said vertical webs.

24. The heat exchanger of claim 21, wherein said dividing wall of said manifold also includes a transversely extending portion, said transversely extending portion comprising reverse curves extending in opposite directions from each of said vertical webs to form a sinusoidal pattern.

25. The manifold of claim 20, wherein said manifold has a flattened oval cross-section.

26. The manifold of claim 20, wherein said manifold has a circular cross-section.

27. The manifold of claim 20, wherein said manifold has a rectangular cross-section.

* * * * *